United States Patent [19]

Fletcher et al.

[11] 4,092,648

[45] May 30, 1978

[54] REFLEX FEED SYSTEM FOR DUAL FREQUENCY ANTENNA WITH FREQUENCY CUTOFF MEANS

[76] Inventors: James C. Fletcher, Administrator of the National Aeronautics and Space Administration, with respect to an invention of; Robert W. Hartop, South Pasadena, Calif.

[21] Appl. No.: 780,728

[22] Filed: Mar. 24, 1977

[51] Int. Cl.[2] ..... H01Q 19/14

[52] U.S. Cl. ..... 343/782; 343/837; 343/781 CA

[58] Field of Search ..... 343/781 CA, 782, 837, 343/838

[56] References Cited

U.S. PATENT DOCUMENTS 3,763,493 10/1973 Shimada et al. ..... 343/781 CA

*Primary Examiner*—Alfred E. Smith
*Assistant Examiner*—David K. Moore
*Attorney, Agent, or Firm*—Monte F. Mott; John R. Manning; Paul F. McCaul

[57] ABSTRACT

A reflex feed system for a dual frequency antenna which may be, for example, one which transmits and receives both S and X-band signals, uses, in place of the dichroic plate normally employed for directing X-band radiation away from the X-band horn a flange about the opening of the X-band horn.

5 Claims, 3 Drawing Figures

REFLEX FEED SYSTEM FOR DUAL FREQUENCY ANTENNA WITH FREQUENCY CUTOFF MEANS

ORIGIN OF INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to antennas and more particularly to an improved reflex feed system for a dual frequency antenna.

It has been the custom to employ, with antennas transmitting dual frequencies, such as S-band and X-band frequencies, a dichroic plate for reflecting the S-band signals to the ellipsoidal reflector and cone of the S-band horn, while passing X-band signals to the X-band horn. It has been found that this dichroic plate causes two to three Kelvins noise temperature increase at the X-band frequency. Further, the dichronic plate must be separately mounted and aligned, requiring special installation and calibration procedures. It would be therefore, desirable to eliminate the plate, if possible.

OBJECTS AND SUMMARY OF THE INVENTION

An object of this invention is to provide a reflex speed system for a dual frequency antenna which does not require a dichroic plate.

Another object of this invention is the provision of a reflex speed system for dual frequency antenna wherein the function of the dichroic plate is performed without an increase in the noise temperature at high frequency.

Still another object of the present invention is the provision of a new and novel reflex feed system for a dual frequency antenna.

The foregoing and other objects of the invention are achieved by replacing the dichroic plate with a flange which is on, or a part of the aperture assembly of the X-band horn, and which is mounted at an angle to reflect the S-band energy to the ellipsoidal reflector of the S-band horn. The throat of the X-band horn is below cutoff at the S-band frequency and therefore appears as a solid reflector plate to the S-band, but is transparent to the X-band.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
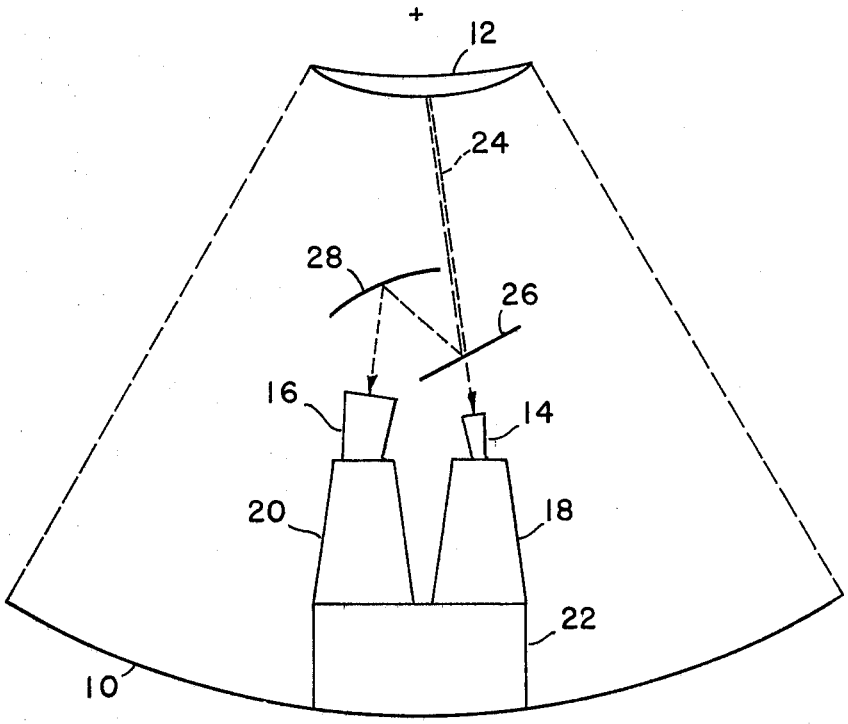
FIG. 1 is a schematic drawing of the presently employed dual frequency antenna, illustrating its reflex feed system.

Referring to FIG. 1, the incoming energy, which is, by way of example, at X-band and S-band frequencies, is received by the main reflector 10 of the antenna, which redirects it to the subreflector 12 in the cassegrainian configuration. The subreflector 12 redirects the energy to the feed cone assembly, which includes the X-band feed horn, 14, and an S-band feed horn 16. The feed horns, respectively 14 and 16 are mounted within feed cones respectively 18 and 20, which in turn are connected to transmitting and receiving apparatus 22.

The X-band and S-band radiation, represented by the dotted lines, 24, are directed by the subreflector at the dichroic plate 26, which passes X-band radiation to the X-band horn 14, and reflects S-band radiation to an ellipsoidal S-band reflector 28. The S-band reflector redirects the S-band energy to the S-band horn.

As indicated, the presence of the dichroic plate, through which the X-band energy must pass, causes at least 2–3 Kelvins noise temperature increase with consequent reduction in ability to receive or discern same signals.

Figure 2:
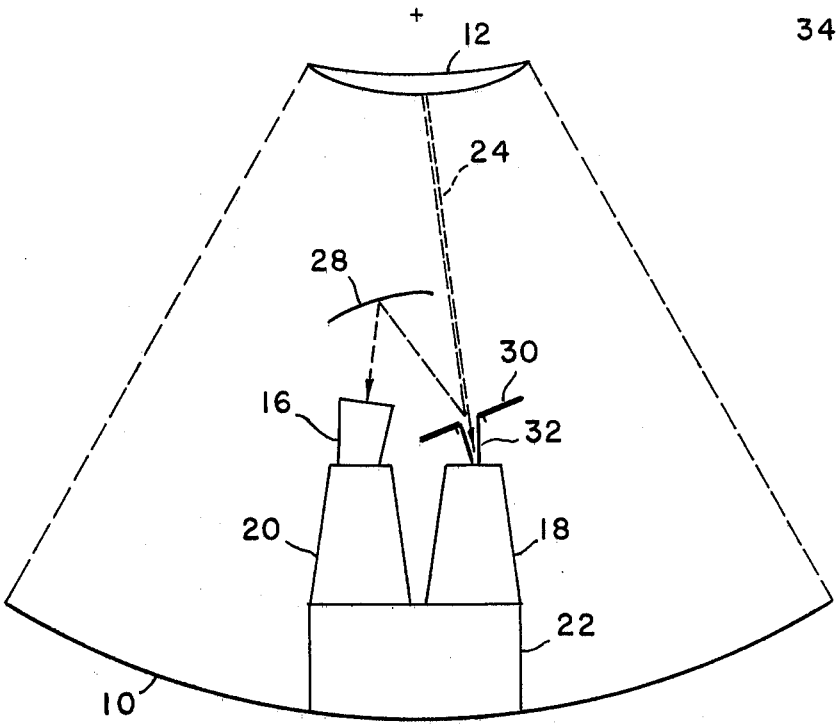
FIG. 2 is a schematic drawing of a dual frequency antenna having a reflex feed system in accordance with this invention.

FIG. 2 is a schematic drawing of the reflex feed system in accordance with this invention. These structures which are the same as the ones shown in FIG. 1 bear the same reference numerals. The dichroic plate is eliminated. The feed horn 14 is also omitted since the flange structure may be fabricated to include horn structure 32. A circular flange 30 is mounted on the X-band horn 32 at an angle to the axis of the X-band horn, which serves to reflect the S-band energy to the ellipsoidal reflector 28 and from there to the S-band horn 16. Because of the required flange angle, one side of the X-band feed horn is longer than the other. However, the field pattern of the X-band horn is not affected provided a dual-mode design is utilized. In an embodiment of the invention which was constructed, the flange was made to have a diameter of about five feet for X-band reflection. It was constructed of the same material as the horn, i.e., aluminum, or copper.

Because the throat of the high frequency or X-band feed is below cutoff at the S-band or low frequency, the flange, which replaces the dichroic plate, appears to be shorted (or solid) at the low frequency. Adjusting the exact length of the high frequency horn allows the short to appear exactly at the aperture. To improve performance at both X and S band frequencies low and high frequency rings, which may be called choke rings and which comprise circular slots, shown in FIG. 3, may be cut into the flange surface.

Figure 3:
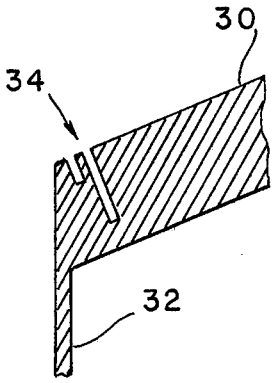
FIG. 3 is an enlarged sectional view of the flange, illustrating choke rings.

FIG. 3 is an enlarged sectional view of a portion of the flange 30 mounted on the horn 32. The X and S band choke rings 34, may be cut into the top flange surface. The technique for making these rings is well known by those skilled in the art.

The use of the flange reflector in place of the dichroic plate provides a simpler structure as well as one which is less expensive to fabricate, and which is easy to install and align. Further, and most importantly, it results in improved overall system performance due to reduced noise temperature contribution of the antenna.

I claim:

1. In a dual frequency antenna system of the type which transmits or receives signals at a first high frequency which is high relative to signals at the second lower frequency, and wherein a reflex feed system is provided in which the signals are directed in a first path toward a high frequency horn, and where it is necessary to permit the high frequency energy in said first path to reach a high frequency horn, but to redirect the lower frequency signals from said first path to a second path to be received by a lower frequency horn, the improvement comprising:

a flange means mounted on said high frequency horn for redirecting lower frequency signals to said second path while blocking said lower frequency signals from flowing through said high frequency horn.

2. An antenna as recited in claim 1 wherein there is included means for supporting said flange means at an angle to said first path for deflecting said lower frequency signals into said second path.

3. A dual frequency antenna of the type wherein a cassegrainian main reflector reflects signals at a first high frequency which is high relative to signals at a second lower frequency onto a subreflector, there are provided in side by side relationship, receiving means including a first high frequency horn and a second lower frequency horn, and said subreflector directs the high and lower frequency signals at said high frequency horn, the improvement comprising:

flange means mounted on said high frequency horn for directing lower frequency energy away from said high frequency horn, while blocking said lower frequency signals from flowing through said high frequency horn; and a reflector positioned to receive the reflected lower frequency energy and direct it at said lower frequency horn.

4. An antenna as recited in claim 3 wherein said high frequency horn has an aperture into which said high frequency energy is directed by said subreflector, and there is provided means for supporting said flange means about the opening of said high frequency horn at an angle for directing said lower frequency energy at said reflector.

5. An antenna as recited in claim 3 wherein there are choke rings cut into the surface of said flange means which are operative at said respective high and lower frequencies.

* * * * *